United States Patent [19]

Noble et al.

[11] 4,286,674

[45] Sep. 1, 1981

[54] REPLACEABLE BEARING ASSEMBLY FOR CONSTRUCTION VEHICLES

[75] Inventors: Charles M. Noble, Shorewood; James A. Olthoff, South Holland, both of Ill.

[73] Assignee: Caterpillar Tractor Co., Peoria, Ill.

[21] Appl. No.: 93,077

[22] PCT Filed: Sep. 24, 1979

[86] PCT No.: PCT/US79/00763

§371 Date: Sep. 24, 1979

§102(e) Date: Sep. 24, 1979

[87] PCT Pub. No.: WO81/00897

PCT Pub. Date: Apr. 2, 1981

[51] Int. Cl.[3] ..... E02F 3/76; F16C 25/04

[52] U.S. Cl. ..... 172/811; 308/74; 403/21; 403/76; 172/827

[58] Field of Search ..... 172/801-809; 308/2 R, 15, 22, 72, 74, DIG. 2; 403/21, 76, 56, 77, 141, 143; 280/400, 481

[56] References Cited

U.S. PATENT DOCUMENTS

| | | | |
|---|---|---|---|
| 945,110 | 1/1910 | Smith | 403/21 |
| 1,113,209 | 10/1914 | Flaherty | 308/74 |
| 2,808,666 | 10/1957 | Schneckloth | 172/803 |
| 2,942,363 | 6/1960 | Long | 172/803 |
| 2,995,953 | 8/1961 | DeFazi | 308/72 X |
| 3,208,805 | 9/1965 | Mayer | 308/72 X |
| 3,597,025 | 8/1971 | Ringle | 308/72 |
| 3,684,324 | 8/1972 | Sterner | 308/22 |
| 3,806,158 | 4/1974 | Casey | 308/72 |
| 3,815,938 | 6/1974 | Molby | 308/72 |
| 3,922,040 | 11/1975 | Carter | 308/72 |
| 3,941,195 | 3/1976 | Stedman | 172/801 |
| 3,964,803 | 6/1976 | Eftefield | 172/801 |
| 3,974,882 | 8/1976 | Eftefield | 172/803 |

FOREIGN PATENT DOCUMENTS

| | | | |
|---|---|---|---|
| 876197 | 7/1942 | France | 308/74 |

*Primary Examiner*—Richard J. Johnson

*Attorney, Agent, or Firm*—Phillips, Moore, Weissenberger, Lempio & Majestic

[57] ABSTRACT

The push arms of a conventional bulldozer assembly are mounted on a track roller frame of a track-type tractor by bearing assemblies, each including a pair of bearing caps. One of the bearing caps is welded to the push arm, thus requiring that it be cut-off upon replacement thereof. In addition, the bearing cap welded to the push arm must be selectively hardened to avoid stress cracking in the heat affected zone of the weld. This invention overcomes the above problems by providing a bearing assembly (16) which includes a pair of separable first and second bearing caps (17, 17') which are secured together and to the push arm by common fasteners (28).

11 Claims, 6 Drawing Figures

FIGURE 1
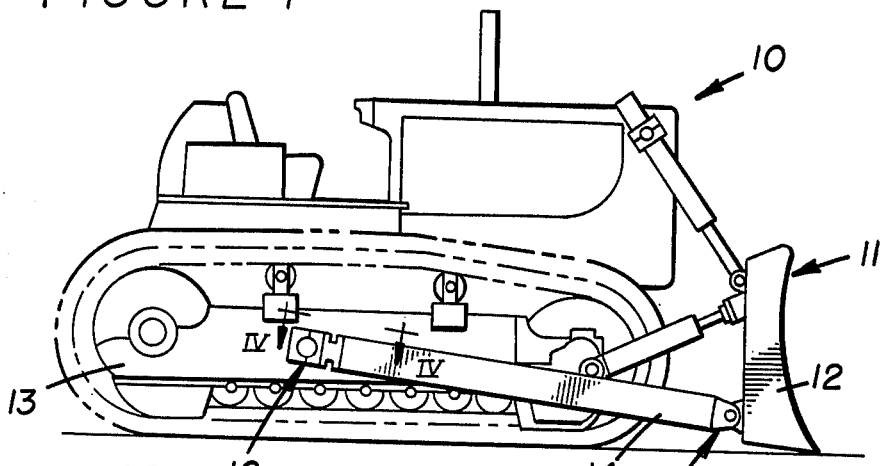
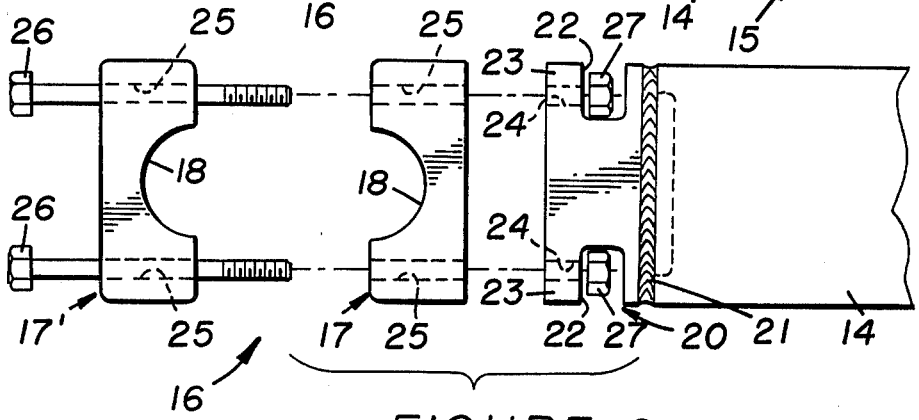
FIGURE 2
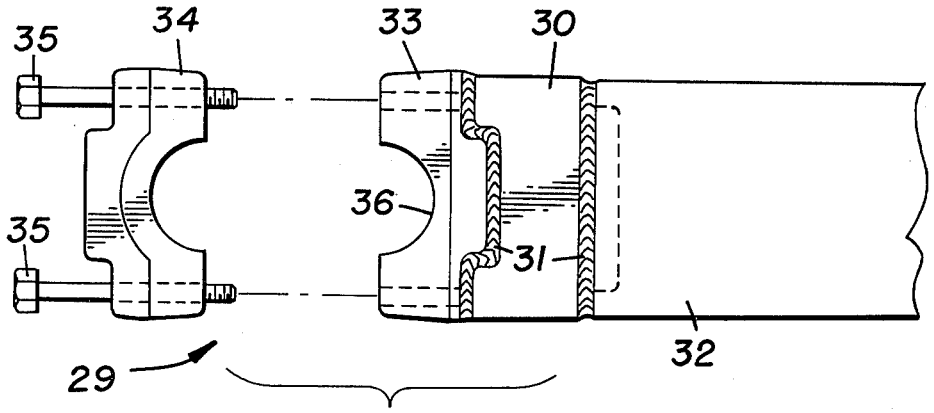
FIGURE 3
(PRIOR ART)

REPLACEABLE BEARING ASSEMBLY FOR CONSTRUCTION VEHICLES

DESCRIPTION

Technical Field

This invention relates to a multi-part bearing assembly for pivotally mounting a work member on a vehicle.

Background Art

The bearing assemblies, pivotally mounting work members on a construction vehicle, are oftentimes subjected to loads of high magnitude. Such bearing assemblies thus require periodic replacement or repair. Replacement or repair of conventional bearing assemblies requires prolonged "downtime" of the construction vehicle and involves considerable expense.

For example, the push arms or C-frame of a bulldozer assembly are pivotally mounted on track roller frames of a track-type tractor by a pair of bearing assemblies that require periodic replacement or repair due to the heavy thrust loads imposed thereon during operation of the bulldozer assembly. As shown in FIG. 3 of the drawings, it is common practice to weld a first bearing cap 33 of each bearing assembly to a respective push arm 32 and a second bearing cap 34 is releasably secured to the first bearing cap to mount the push arm on a ball stud secured on a track roller frame. Replacement of the first bearing cap, which is welded to the push arm, requires that it be cut-off the push arm and a replacement part welded in its stead. This procedure is obviously time consuming and costly.

Another problem arising in respect to the welding of the above first bearing cap to the push arm is that the internal spherical bearing surface of the cap must be selectively hardened (e.g., Rockwell C70) since it is subjected to the greatest amount of thrust loads imposed on the push arm while the welding area must be composed of a material having low hardenability to avoid cracking in the heat affected zone. The other bearing cap does not normally require such selective hardening. This selective hardening procedure is also time consuming and adds to the overall cost of the bearing assembly. Furthermore, the two bearing caps must be identified by separate part numbers.

DISCLOSURE OF INVENTION

The present invention is directed to overcoming one or more of the problems as set forth above.

In one aspect of this invention, a first member is pivotally mounted on a second member by a bearing assembly which includes first and second separable bearing caps. Fastening means are provided for releasably securing the first bearing cap to the first member and for further releasably securing the caps together.

In another aspect of this invention the bearing assembly is utilized to pivotally mount a work member on a construction vehicle, e.g., to pivotally mount a push arm or C-frame of a bulldozer assembly on a track roller frame of a track-type tractor, or on the frame of a wheel-type tractor.

The bearing assembly thus avoids the need for welding the first cap to the push arm, for example, which is common practice in the art today. In addition to avoiding the necessity of having to cut-off the first cap for repair or replacement purposes, the first cap does not require selective hardening. Furthermore, the bearing assembly of this invention facilitates the use of the same part number for the first and second caps since they may have identical constructions.

BRIEF DESCRIPTION OF DRAWINGS

FIG. 1 is a side elevational view of a track-type tractor having a bulldozer assembly pivotally mounted thereon by a pair of bearing assembly embodiments of the present invention;

FIG. 2 is an enlarged and exploded side elevational view of one of the bearing assemblies and a portion of a push arm of the bulldozer assembly;

FIG. 3 is a view similar to FIG. 2, but illustrates a prior art bearing assembly;

BEST MODE OF CARRYING OUT THE INVENTION

Figure 4:
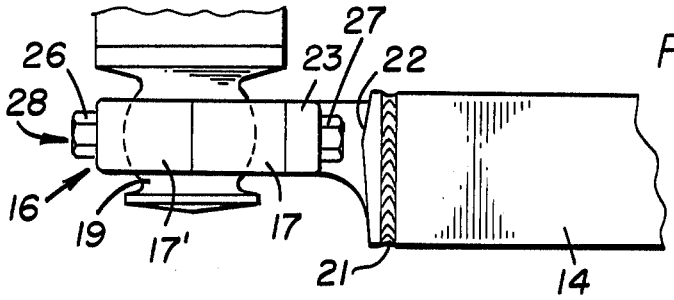
FIG. 4 is an enlarged, top plan view, taken in the direction of arrows IV—IV in FIG. 1, showing the bearing assembly in its assembled condition for pivotally mounting the push arm of the bulldozer assembly on a track roller frame of the tractor.

FIG. 1 illustrates a track-type tractor 10 having a bulldozer assembly 11 mounted forwardly thereon. Bulldozer assembly 11 comprises a generally upright blade 12 connected to a pair of laterally spaced track roller frames 13 (one shown) of tractor 10 by a pair of laterally spaced first members or push arms 14 (one shown). The forward end of each push arm 14 is pivotally connected to blade 12 at a pivot connection 15 whereas a rearward end of the push arm is pivotally connected to a respective track roller frame 13 by a bearing assembly 16, embodying the invention herein. The push arms can also be connected to the frame of a wheel-type tractor.

Figure 5:
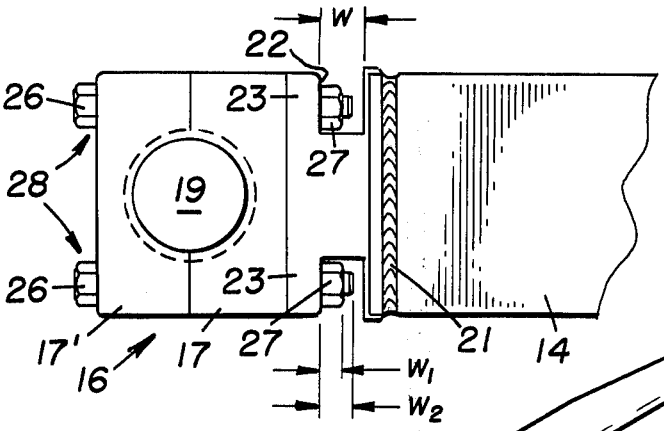
FIG. 5 is a side elevational view of the bearing assembly.

Referring to FIGS. 2,4, and 5, bearing assembly 16 comprises a pair of separable first and second caps 17 and 17′, respectively, which are identical in construction. Thus, the bearing caps can be identified by the same part number and can be subjected to the same manufacturing processes, such as case hardening. Each bearing cap 17 and 17′ has a semispherical bearing surface 18 defined therein whereby upon mounting of the bearing caps on a second member or ball stud 19 (FIG. 4), push arm 14 is adapted to pivot on track roller frame 13.

As shown in FIG. 2, a connector 20 is secured, such as by welds 21, to a rearward end of push arm 14. Connector 20 has a pair of slots 22 formed transversely therethrough a disposed on upper and lower sides of the connector. A pair of upper and lower flanges 23 are thus defined on connector 20 with each flange having a bore 24 formed therethrough. Upon assembly, bores 24 will align with respective bores 25 formed through bearing caps 17 and 17′ to receive a pair of bolts 26 therethrough. As shown in FIGS. 4 and 5, an end portion of each bolt 26 is threadably attached to a nut 27, disposed in a respective slot 22, to thus provide fastening means 28 for releasably securing bearing cap 17 to connector 20 which forms part of push arm 14 and to further releasably secure bearing caps 17 and 17' together.

FIG. 3 illustrates a conventional bearing assembly 29 comprising a connector 30 welded at 31 between a rearward end of a push arm 32 and the backside of a first bearing cap 33. A second bearing cap 34 is releasably secured to bearing cap 33 and connector 30 by a pair of bolts 35. As discussed above, replacement of bearing cap 33, which is subjected to heavier thrust loads than bearing cap 34, requires a cutting-off and replacement by another welded-on bearing cap. Furthermore, bearing cap 33 must be selectively case hardened to avoid stress cracking in the heat affected zone of weld 31, securing the bearing cap to connector 30.

Contrast the drawbacks of conventional bearing assembly 29 with bearing assembly 16 of this invention which is adapted to be assembled and disassembled expeditiously and which may be comprised of identical bearing caps 17 and 17' which are processed and constructed in the same manner and thus can be identified by the same part number.

Industrial Applicability

FIG. 1 illustrates a principle use for the bearing assembly 16 of this invention; namely, for pivotally mounting push arm 14 of bulldozer assembly 11 on track roller frame 13 of track-type tractor 10. However, it should be understood that bearing assembly 16 will find many other applications in construction vehicles or the like wherein a pair of members are pivotally mounted together and heavy thrust loads are imposed on at least one of the members. For example, referring to FIG. 6, bearing assemblies 16 may be utilized for pivotally interconnecting a tag link 37 between a main frame 38 of tractor 10 and blade 12. Tag link 37 essentially functions to transmit side loads imposed on blade 12 to main frame 38 directly to thus eliminate the need for standard diagonal bracing.

Upon assembly of bearing assembly 16, each push arm 14 would be suitably propped-up, adjacent to a respective ball stud 19, with bearing caps 17 and 17' mounted on the ball stud as shown in FIGS. 4 and 5. Insertion of bolts 26 through aligned bores 24 and 25 will thus facilitate securance of nuts 27 on the bolts whereby the bearing assembly is structurally integrated to permit push arm 14 to pivot relative to track roller frame 13. It should be noted that this nested position of nuts 27, within slots 22, substantially protect them against damage.

Furthermore, as shown in FIG. 5, a width W of each slot 22 is less than the combined width $W_1$ of nut 27 and a length $W_2$ defining an end portion of bolt 26 which extends into a respective slot 22. Thus, nuts 27 will be held captive within slots 22 and not subjected to potential dislodgement from bolts 26 during operation of the tractor. The above method of assembly would be reversed should the need arise to replace one or both bearing caps 17 and 17' with new ones.

Figure 6:
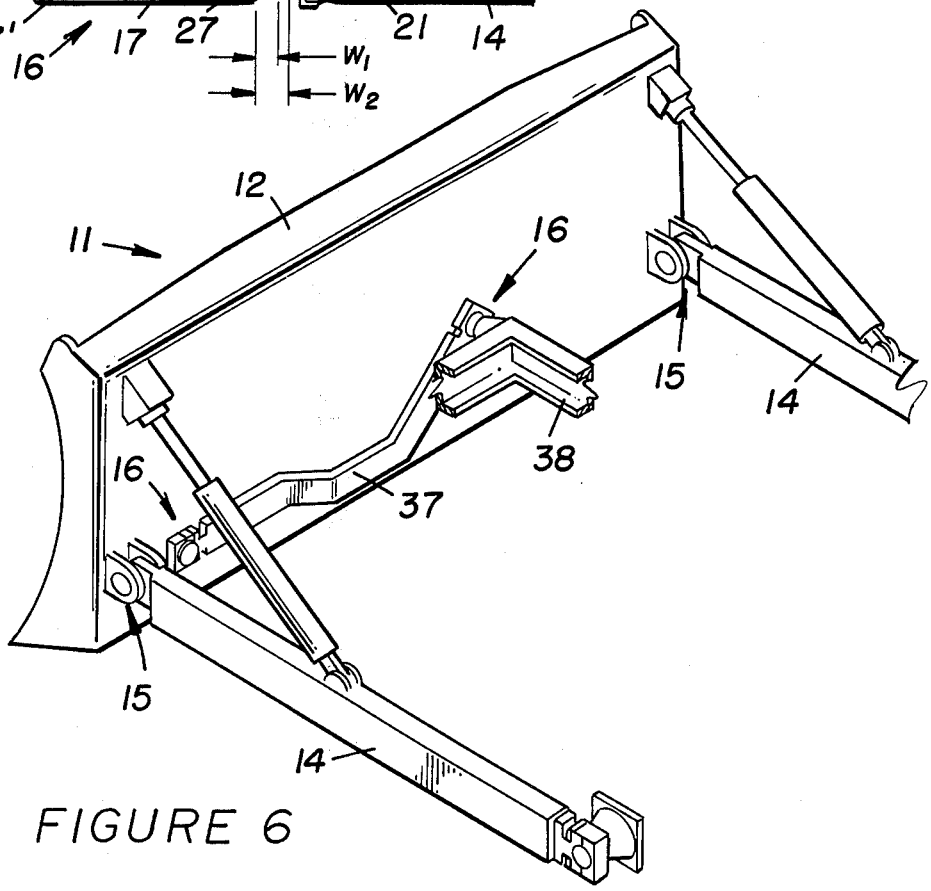
FIG. 6 is a backside, isometric view of the bulldozer assembly, showing application of a pair of bearing assemblies of this invention to a tag link pivotally interconnected between a main frame of the tractor and a blade of the bulldozer assembly.

Also, essentially the same assembly method would be employed for pivotally interconnecting tag link 37 of FIG. 6 between main frame 38 of tractor 10 and blade 12. It should be understood that tag link 37 may be either connected to blade 12 or push arm 14.

We claim:

1. A vehicle having a first member (14), a second member (19), and bearing means (16) for pivotally mounting said first member (14) on said second member (19) and for counteracting thrust loads imposed on said first member (14), said bearing means (16) including separable first (17) and second (17') bearing caps each being separable from each other and from said push arm, fastening means (28) for releasably securing said first bearing cap (17) to said first member (14) and for further releasably securing said first (17) and second (17') bearing caps together, and upper and lower slots (22) defined transversely completely through said first member (14) and wherein said fastening means (28) includes at least two bolts (26) extending sequentially through said second bearing cap (17'), said first bearing cap (17), and said first member (14) and into said slots (22).

2. The vehicle of claim 1 wherein each of said first (17) and second (17') bearing caps are at least substantially identical in construction.

3. The vehicle of claim 1 wherein said first member (14) has a connector (20) secured thereon, said first bearing cap (17) being secured directly to said connector (20).

4. The vehicle of claim 1 wherein said second member (19) includes a ball stud (19) and wherein said first (17) and second bearing caps (17') each defines a semi-spherical bearing surface (18) therein pivotally mounted on said ball stud (19).

5. The vehicle of claim 1 wherein said fastening means (28) further includes a nut (27) disposed within each of said slots (22) and threadably attached to a respective one of said bolts (26).

6. The vehicle of claim 5 wherein the width (W) of each of said slots (22) is less than the combined width ($W_1$) of each said nut (27) and the length ($W_2$) of the end portion of each said bolt (26) extending into each said slot.

7. The combination comprising a first member (14) having upper and lower slots (22) defined transversely completely therethrough, a second member (19), a bearing assembly (16) including a pair of separable first (17) and second (17') bearing caps pivotally mounted on said second member (19), said first (17) and second (17') bearing caps being separable from each other and from said first member (14), common fastening means (28) for releasably securing said first bearing cap (17) to said first member (14) and for further securing said first (17) and second (17') bearing caps together including at least two bolts (26) extending through said first (17) and second (17') bearing caps and into said said first member (14) and each bolt (26) being threadably attached to a nut (27) disposed within a respective one of said slots (22).

8. The combination of claim 7 wherein each of said first (17) and second (17') bearing caps are at least substantially identical in construction.

9. A tractor (10) having a frame (13), a bulldozer assembly (11) having a pair of laterally spaced push arms (14) and upper and lower slots (22) defined transversely completely through a rearward end of each push arm (14), bearing means (16) for pivotally mounting each push arm (14) of said bulldozer assembly (11) on said frame (13), said bearing means (16) including first (17) and second (17') bearing caps separable from each other and from said push arm (14), and fastening means (28) for releasably securing said first bearing cap (17) to a respective push arm (14) of said bulldozer assembly (11) and for further releasably securing said first (17) and second (17') bearing caps together, said fastening means including a nut (27) disposed within each of said slots (22) and a bolt (26) extending through said first (17) and second (17') bearing caps and threadably attached to said nut (27).

10. The tractor (10) of claim 9 wherein each of said first (17) and second (17') bearing caps are at least substantially identical.

11. The tractor (10) of claim 9 further including a ball stud (19) secured on said frame (13) and wherein a pair of said first (17) and second (17') bearing caps are pivotally mounted on said ball stud (19).

* * * * *